US005162030A

United States Patent [19]

Tanski

[11] Patent Number: 5,162,030

[45] Date of Patent: Nov. 10, 1992

[54] VERTICAL BALANCE BAR EXERCISE APPARATUS

[76] Inventor: John Tanski, 24 Janet Dr., New Britain, Conn. 06053

[21] Appl. No.: 587,769

[22] Filed: Sep. 24, 1990

[51] Int. Cl.[5] ..... A63B 21/02

[52] U.S. Cl. ..... 482/91; 482/34; 482/148

[58] Field of Search ..... 272/62-63, 272/68, 93, 109-111, 116, 131, 143; 248/125, 206.5; 182/100; 446/137, 129; 482/114, 91

[56] References Cited

U.S. PATENT DOCUMENTS

| | | | |
|---|---|---|---|
| 618,990 | 2/1899 | Lubber | 272/116 R |
| 696,711 | 4/1902 | Briner | 182/100 |
| 847,066 | 3/1907 | Hall | 446/137 |
| 2,621,043 | 12/1952 | Olmstead | 482/114 |
| 3,209,729 | 10/1965 | Zedaker | 248/206.5 |
| 3,550,936 | 12/1970 | Puttick | 446/129 |
| 3,957,266 | 5/1976 | Rice | 272/131 X |
| 4,036,490 | 7/1977 | Rice | 272/68 |
| 4,794,905 | 1/1989 | Woolard | 446/129 |

FOREIGN PATENT DOCUMENTS

| | | | |
|---|---|---|---|
| 776040 | 1/1968 | Canada | 272/110 |
| 2152399 | 4/1973 | Fed. Rep. of Germany | 272/131 |
| 1580920 | 9/1969 | France | 248/206.5 |
| 922308 | 3/1963 | United Kingdom | 272/109 |
| 2057276 | 4/1981 | United Kingdom | 272/131 |

*Primary Examiner*—Richard J. Apley
*Assistant Examiner*—Jerome Donnelly
*Attorney, Agent, or Firm*—Robert S. Smith

[57] ABSTRACT

An exercise apparatus for performing one leg squats and the like which includes a bar, apparatus for supporting the bar in a substantially vertical position; and a grip carried on the bar mounted for sliding axial movement on the bar. In other forms of the invention the apparatus for supporting includes mounting structure configured for cooperation with a wall of a room. The apparatus for supporting may comprise as least one v-shaped bracket having an apex and the vertical bar constrained by the bracket at the apex.

2 Claims, 1 Drawing Sheet

VERTICAL BALANCE BAR EXERCISE APPARATUS

BACKGROUND OF THE INVENTION

The invention relates to exercise apparatus and particularly to exercise apparatus for assisting a person to perform so-called single leg bend squats. The exercises are typically performed by a person beginning in a standing position and extending one leg out to his or her front and then dropping his or her torso down toward the floor to a squatting position with the other knee bent. The exercise is performed without using the hands to aid either lowering oneself or raising oneself and, in fact, the hands are held on the hips of the person performing the exercise. This exercise can greatly strengthen the leg muscles, however, the exercise is very difficult to perform because of the difficulty of maintaining one's balance while repetitively raising and lowering one's body while supported upon a single leg.

The prior art includes apparatus such as that shown in U.S. Pat. No. 4,036,490. That patent shows a cylindrical element which appears to be disposed on a vertical bar having bulbous enlargements at axially spaced intervals. In fact, the cylindrical elements do not function in combination with the vertical bar with the bulbous enlargements and thus the apparatus is distinc from the present apparatus.

It is an object of the invention to provide apparatus which will assist a person in performing such one leg squat without compromising the exercise benefits of the one leg squat.

It is another object of the invention to provide apparatus which will minimize the danger of accidental fall and even injuries which may occur in performing one leg squats and the like which may cause inadvertent falls and possible injuries.

It is another object of the invention to provide apparatus which is simple and inexpensive to manufacture, as well as to install.

SUMMARY OF THE INVENTION

It has now been found that these and other objects of the invention may be attained in an exercise apparatus for performing one leg squats and the like which includes a bar, means for supporting the bar in a substantially vertical position; and a grip carried on the bar mounted for sliding axial movement on the bar.

In other forms of the invention the means for supporting including mounting structure configured for cooperation with a wall of a room. The means for supporting may comprise as least one v-shaped bracket having an apex and the vertical bar constrained by the bracket at the apex.

The grip may include a Teflon inner liner to facilitate ease of movement on the vertical bar. A magnetic means may be disposed proximate to the upper axial extent of the vertical member for retaining the grip when the apparatus is not in use.

BRIEF DESCRIPTION OF THE DRAWING

The invention will be better understood by reference to the accompanying drawing in which.

DESCRIPTION OF THE PREFERRED EMBODIMENT

Figure 1:
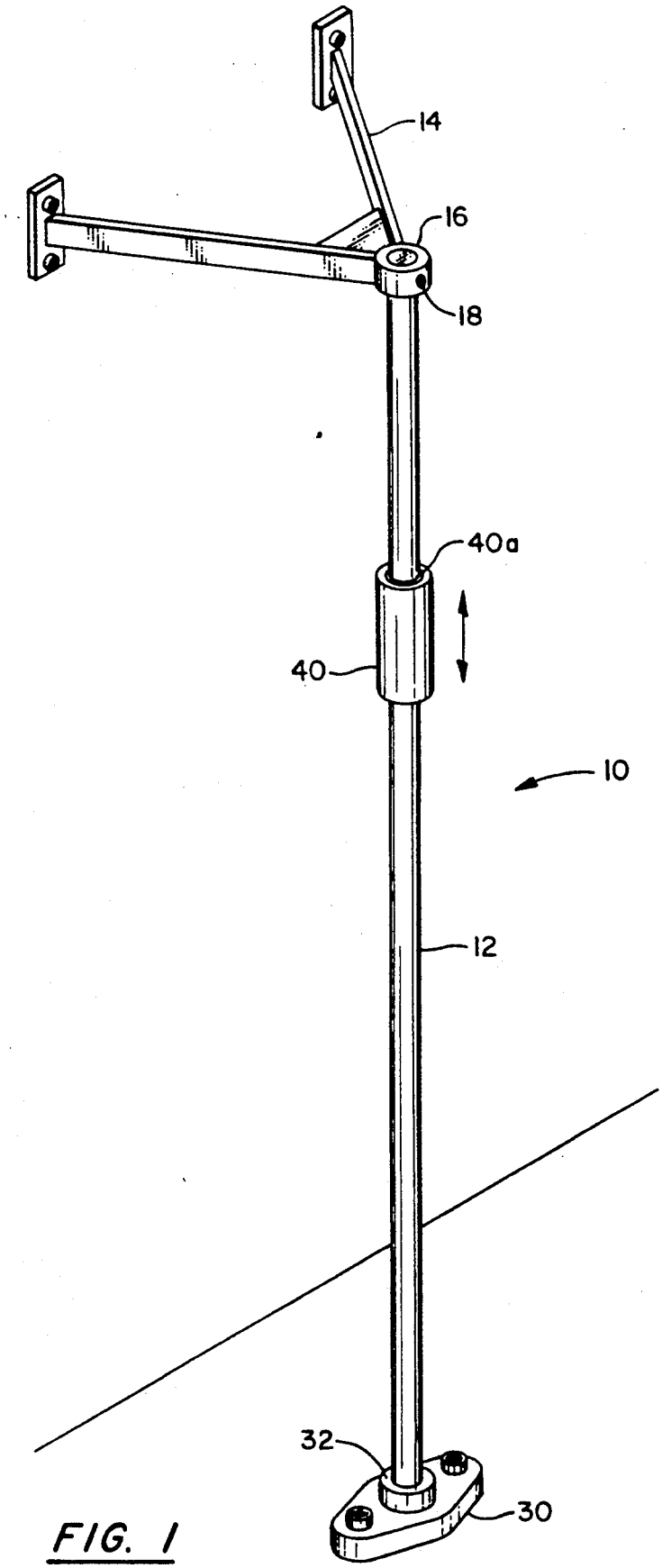
FIG. 1 is a perspective view of the apparatus in accordance with one form of the invention.
Figure 2:
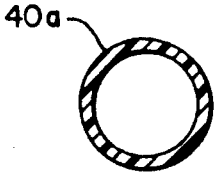
FIG. 2 is a cross-sectional view, to an enlarged scale, taken at one axial position of the sliding grip shown in FIG. 1.

Referring now to FIG. 1-2 there is shown an exercise apparatus 10 which includes a vertical bar 12 which is held by a generally v-shaped support 14 at the upper axial extent thereof. The support 14 includes a journal element 16 to retain the vertical bar 12 by means of a set screw 18.

The lower axial extremity of the vertical bar 12 is supported by plate 30 which includes a journal element 32 into which the lower axial extremity of the bar 12 is disposed. In some forms of the invention, the plate 30 may be welded to the bar 12. In other forms of the invention, a set screw (not shown) may be utilized to secure the bar 12 in the journal element 32.

Disposed on the bar 12 is a moveable grip 40 which is generally cylindrical in which, in the preferred form, includes means on the interior thereof to permit easy sliding on the vertical bar 12. In one preferred form, the internal surface of the grip 40 is lined with Teflon (trademark of the DuPont Company) 40*a* (shown in greater detail in FIG. 2). In other forms, the interior may be provided with roller bearings, self lubricating bearings, bronze bushings that are oil impregnated. Preferably the use of oil is avoided to prevent soiling the clothes of the user as well as other persons who may pass by the apparatus.

In the preferred form, the vertical bar 12 has a height of about 5 feet and is held in the vertical position by means of the plate 30 and the bracket approximately 1 foot away from a wall. It will be understood that this distance is controlled by the dimension of the support 14.

The vertical bar 12 ordinarily will have a diameter of approximately ⅝ inch and will be manufactured of steel as will the hand grip that slides thereon. The hand grip ordinarily will be provided with a rubber or rubber-like material on the exterior surface which, in addition to some cushioning material to provide a comfortable hand grip material for the user.

Preferably, the bar 12 will be highly polished and have a substantially uniformed diameter throughout its length so that the grip 40 will slide easily thereon.

In some forms of the invention the grip 40 may be magnetized or may carry a discrete magnet. In this embodiment the grip 40 will "latch" in place against the journal element 16 which ordinarily will be manufactured of a ferrous metal. Alternatively, the journal element 16 may be magnetized and the grip may be made be made of is made of a ferrous metal.

It will be understood that the apparatus in accordance with the invention facilitates the performance of one leg squats as well as other exercises which will greatly enhance the muscular fitness of the user. It will be understood that the apparatus will minimize the danger of falling and possible injury.

It will be understood that in various forms of the invention that the brackets supporting the vertical bar may differ substantially from the structure which has been shown herein. It is ordinarily a requirement, however, that the vertical bar be spaced apart from the surrounding wall so that the user will have at least enough room for easy movement of his hand between the vertical bar and the surrounding wall. Preferably, the space will be in the order of about a foot, although not that much room is absolutely essential to practice the invention.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. Exercise apparatus for performing one leg squats and the like which comprises:

a bar;

means for supporting said bar in a substantially vertical position, said means for supporting including mounting structure configured for cooperation with a wall of a room and comprising as least one v-shaped bracket having an apex and said vertical bar is constrained by said bracket at said apex;

a rigid, non-compressible grip means carried on said bar and mounted for free unencumbered, bidirectional, sliding axial movement on said bar; and a magnetic means disposed proximate to the upper axial extent of said vertical bar for retaining said grip means when the apparatus is not in use.

2. The apparatus as described in claim 1 wherein:

said grip means includes a polytetrafluoroethylene inner liner to facilitate ease of movement on said vertical bar.

* * * * *